US007409172B2

(12) United States Patent
Koshida

(10) Patent No.: US 7,409,172 B2
(45) Date of Patent: Aug. 5, 2008

(54) IMAGE FORMING APPARATUS

(75) Inventor: Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 11/374,198

(22) Filed: Mar. 14, 2006

(65) Prior Publication Data

US 2006/0222394 A1 Oct. 5, 2006

(30) Foreign Application Priority Data

Mar. 29, 2005 (JP) ..... 2005-094639

(51) Int. Cl.
*G03G 15/20* (2006.01)
*G03G 15/00* (2006.01)

(52) U.S. Cl. ..... 399/68; 399/44

(58) Field of Classification Search ..... 399/44, 399/45, 68

See application file for complete search history.

(56) References Cited

U.S. PATENT DOCUMENTS

| | | | | |
|---|---|---|---|---|
| 2003/0156853 | A1* | 8/2003 | Fukutani | 399/68 |
| 2006/0051116 | A1 | 3/2006 | Koshida | 399/68 |
| 2006/0120744 | A1 | 6/2006 | Shirakata et al. | 399/68 |
| 2006/0222386 | A1 | 10/2006 | Koshida et al. | 399/44 |
| 2006/0263128 | A1 | 11/2006 | Takematsu et al. | 399/401 |
| 2007/0059023 | A1 | 3/2007 | Koshida | 399/92 |

FOREIGN PATENT DOCUMENTS

| | | | |
|---|---|---|---|
| EP | 1 338 927 | A | 8/2003 |
| EP | 1 353 243 | A2 | 10/2003 |
| EP | 1 391 788 | A2 | 2/2004 |
| JP | 5-107966 | | 4/1993 |
| JP | 7-234604 | | 9/1995 |
| JP | 2000056529 | A * | 2/2000 |
| JP | 2003-241453 | | 8/2003 |
| JP | 2006053299 | A * | 2/2006 |

OTHER PUBLICATIONS

Official Communication/Search Report, issued by the European Patent Office on Nov. 24, 2006, in European Patent Application No. 06006021.7.

* cited by examiner

*Primary Examiner*—Ryan Gleitz
(74) *Attorney, Agent, or Firm*—Fitzpatrick, Cella, Harper & Scinto

(57) ABSTRACT

An image forming apparatus includes a plurality of loop detecting sensors which detect various levels of loops formed on a recording material; and a controlling device which selects a specific one out of the loop sensors in accordance with information on the recording material, and then, switches a conveyance speed of a fixing roller pair in response to a detection signal output from the specific sensor, so as to control in such a manner as to keep the loop of the recording material within a constant range, the controlling device selecting the loop detecting sensor for detecting a loop of a level in accordance with the information on the recording material, so as to perform a loop keeping control for the recording material in response to the detection signal output from the selected loop detecting sensor.

10 Claims, 11 Drawing Sheets

*FIG. 8*

Memory 51

| Size | Ambience | Paper thickness | Information table | Sensor during times Ts – Tr | Sensor during times Tr – Te |
|---|---|---|---|---|---|
| A4 | high humidity | thin paper | d1 | S1 | S2 |
| | | plain paper | d2 | S1 | S2 |
| | | thick paper | d3 | S2 | S2 |
| | low humidity | thin paper | d4 | S1 | S2 |
| | | plain paper | d5 | S2 | S2 |
| | | thick paper | d6 | S2 | S2 |

IMAGE FORMING APPARATUS

BACKGROUND OF THE INVENTION

1. Field of the Invention

The present invention relates to an image forming apparatus of an electrophotographic type, in which a unfixed image is transferred onto a recording material at a transfer portion, and then, the unfixed image is fixed onto the recording material in a fixing device.

2. Description of the Related Art

In a conventional image forming apparatus of an electrophotographic type, a unfixed image borne by an intermediate transfer belt 102 has been transferred onto a recording material P by a transfer roller pair 103, to be then fixed onto the recording material P by a fixing roller pair 105, and thereafter, the recording material having the image fixed thereto has been discharged to a discharge tray 107 disposed outside of the apparatus by a discharge roller pair 111, as shown in FIG. 11.

The fixing roller pair 105 has been adapted to heat-fix the unfixed image onto the recording material. Heat temporarily dissipated from fixing rollers during the fixing process has been variously changed according to an amount of adhesion of a developer forming the unfixed image transferred onto the recording material, the number of recording materials passing through the fixing roller pair per unit time a difference in thermal capacity of the recording material, or the like. A temporary change in temperature generated in the fixing roller pair 105 has appeared as a change in outer diameter of the roller. As a consequence, there has possibly occurred a difference between a recording material conveyance speed of the fixing roller pair 105 and a recording medium conveyance speed of the transfer roller pair 103.

In this manner, the difference in recording material conveyance speed between the fixing roller pair 105 and the transfer roller pair 103 has possibly induced degradation of an image quality. In other words, if the recording material conveyance speed of the fixing roller pair 105 is higher than that of the transfer roller pair 103, a tension has been applied to a recording material P between the fixing roller pair 105 and the transfer roller pair 103, so that a blur of an image has occurred when the image is transferred onto the recording material P by the transfer roller pair 103, thereby possibly inducing the degradation of the image quality. In contrast, if the recording material conveyance speed of the fixing roller pair 105 is lower than that of the transfer roller pair 103, the recording material P has formed excessive loop between the fixing roller pair 105 and the transfer roller pair 103. As a result, the recording material P which has formed excessive loop has been forcibly pressed against a conveyance guide 120, to be scraped. Such a scrape on the conveyance guide 120 has generated the blur of the image during the transfer of the image, thereby possibly inducing the degradation of the image quality.

Therefore, the above-described degradation of the image quality has been overcome by preventing any tension from being applied to the recording material P by forming a predetermined loop on recording material P between the transfer roller pair 103 and the fixing roller pair 105 or preventing the recording material P from being excessively flexed, there has been conventionally proposed, as follows:

As shown in FIG. 11, a loop detecting sensor S for detecting a level of a loop of the recording material P has been disposed in the conveyance guide 120 between the fixing roller pair 105 and the transfer roller pair 103, and then, in response to a detection result, the recording material conveyance speed of the fixing roller pair 105 has been switched to a first speed lower than the recording material conveyance speed of the transfer roller pair 103 or a second speed higher than the first speed, thereby keeping the level of the loop within a predetermined range. Such a technique has been disclosed in Japanese Patent Application Laid-open (JP-A) Nos. 5-107966 and 7-234604.

By the technique shown in FIG. 11, when the recording material P is sandwiched and transported between the transfer roller pair 103 and the fixing roller pair 105, an image can be formed while the level of the loop of the recording material P has been kept within the predetermined range by the effect of the difference in speed between both of the roller pairs 103 and 105 in response to the detection result by the loop detecting sensor S.

However, since the level of the loop of the recording material P, formed by the effect of the difference in speed between both of the roller pairs 103 and 105 is constant all the time, the recording material P has bounced up at the rear end thereof due to its own tenacity when the rear end of the recording material P passes through the transfer roller pair 103 in the case of, for example, a high set level of the loop. Such a bounce of the recording material P has caused the blur of the image, thereby possibly inducing the degradation of the image quality.

In order to solve the problem of the bounce of the rear end of the recording material, Japanese Patent Application Laid-open (JP-A) No. 2003-241453 discloses a technique, in which an image is formed while the level of a loop of a recording material is kept within the predetermined range, and further, a conveyance speed is switched to a speed, at which the loop of the recording material is reduced, when the rear end of the recording material reaches a predetermined position in a transfer portion. With this technique, the rear end of the recording material can pass through the transfer portion at a low level of the loop of the recording material, thus to prevent from bounce.

However, the configuration, in which the level of the loop of the recording material is reduced by switching the speed, has raised a problem, as described below.

With this configuration, if a timing of the switch of the conveyance speed for the purpose of the reduction of the level of the loop is shifted or a conveyance condition is varied due to a slippage caused by a type of recording material (i.e., a surface state or a rigidity), the recording material may pass through the transfer portion at various timings. Therefore, in the case where the rear end passes through the transfer portion before the loop becomes satisfactorily small, the bounce of the rear end cannot be securely prevented. In contrast, in the case where the rear end passes through the transfer portion after there is no loop of the recording material, a fixing roller pair has applied a tension to the recording material since the conveyance force of the fixing roller pair is normally greater than that at the transfer portion, thereby possibly inducing a deficient transfer at the transfer portion. As described above, the prior art has experienced the problem that the rear end of the recording material cannot be stably prevented from bouncing up.

SUMMARY OF THE INVENTION

An object of the invention is to securely suppress degradation of an image quality or the like caused by a conveyance condition of a recording material after a leading end of the recording material is nipped in a fixing device until a rear end of the recording material passes through a transfer portion in an image forming apparatus, in which a loop is formed on the recording material between the transfer portion and the fixing device.

According to the invention, An image forming apparatus comprising:

a transfer portion which transfers a unfixed image borne by an image bearing member onto a recording material;

a fixing device which fixes the unfixed image transferred at the transfer portion onto a recording material;

a controlling device which controls a recording material conveyance speed of the fixing device so as to form a loop of the recording material between the transfer portion and the fixing device in a first mode which keep the loop of the recording material within a first range and in a second mode which keep the loop within a second range, a level of the loop within the second range is smaller than a level of the loop within the first range;

wherein after a leading end of the recording material reaches the fixing device, the controlling device controls the recording material conveyance speed of the fixing device in the first mode, and before a rear end of the recording material reaches the transfer portion, the controlling device controls the recording material conveyance speed of the fixing device in the second mode.

BRIEF DESCRIPTION OF THE DRAWINGS

FIG. 8 is a table illustrating constant tables stored in a memory in the image forming apparatus according to a second embodiment of the invention;

DESCRIPTION OF THE EMBODIMENTS

Hereinafter, explanation will be illustratively made in detail according to the embodiment of the invention in reference to the attached drawings. Here, the size, material and shape of each of component parts described below in the embodiments and their relative arrangement should be appropriately varied according to the constitution of an apparatus, to which the invention is applied, or various conditions. Therefore, the scope of the invention should not be limited only to the embodiments as long as there is no specific description.

First Embodiment

Figure 1:
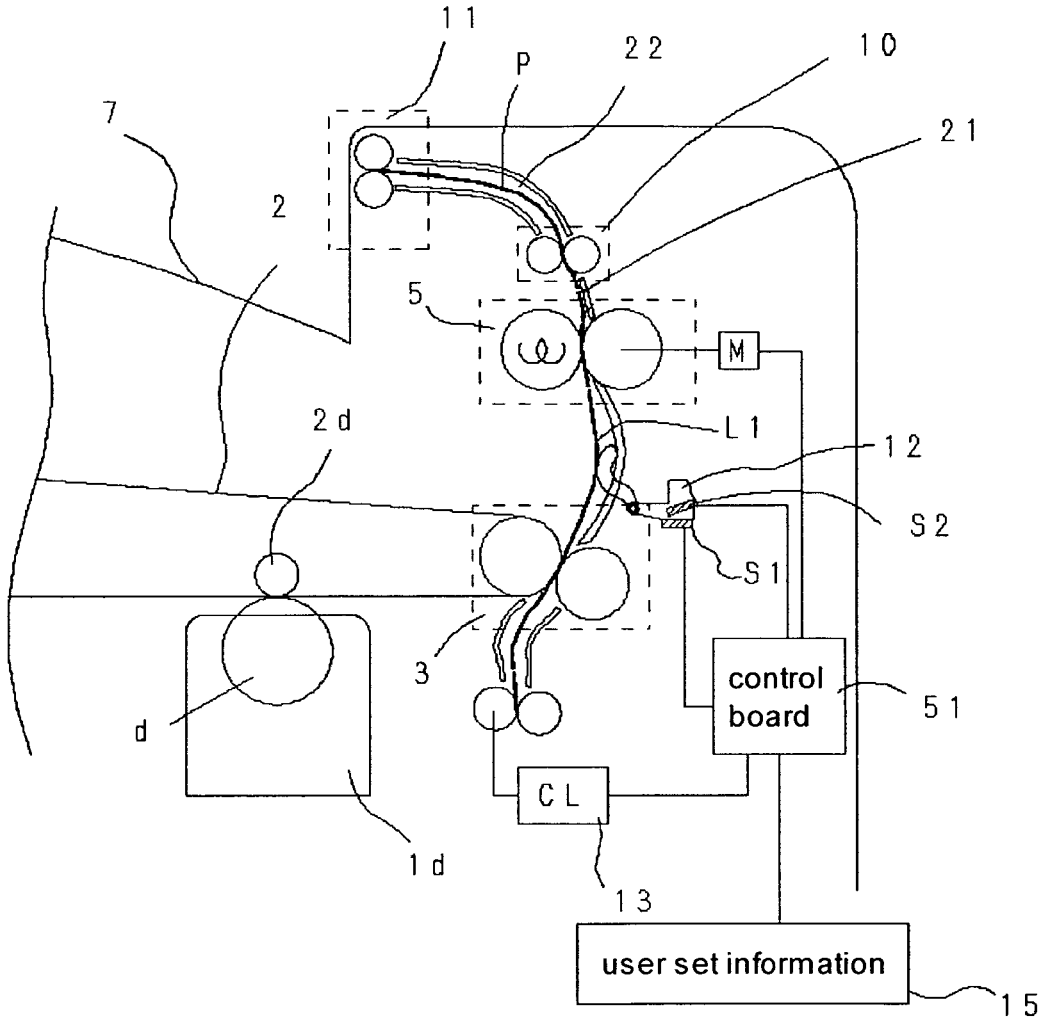
FIG. 1 is a cross-sectional view showing essential parts of an image forming apparatus according to an embodiment of the invention.
Figure 2:
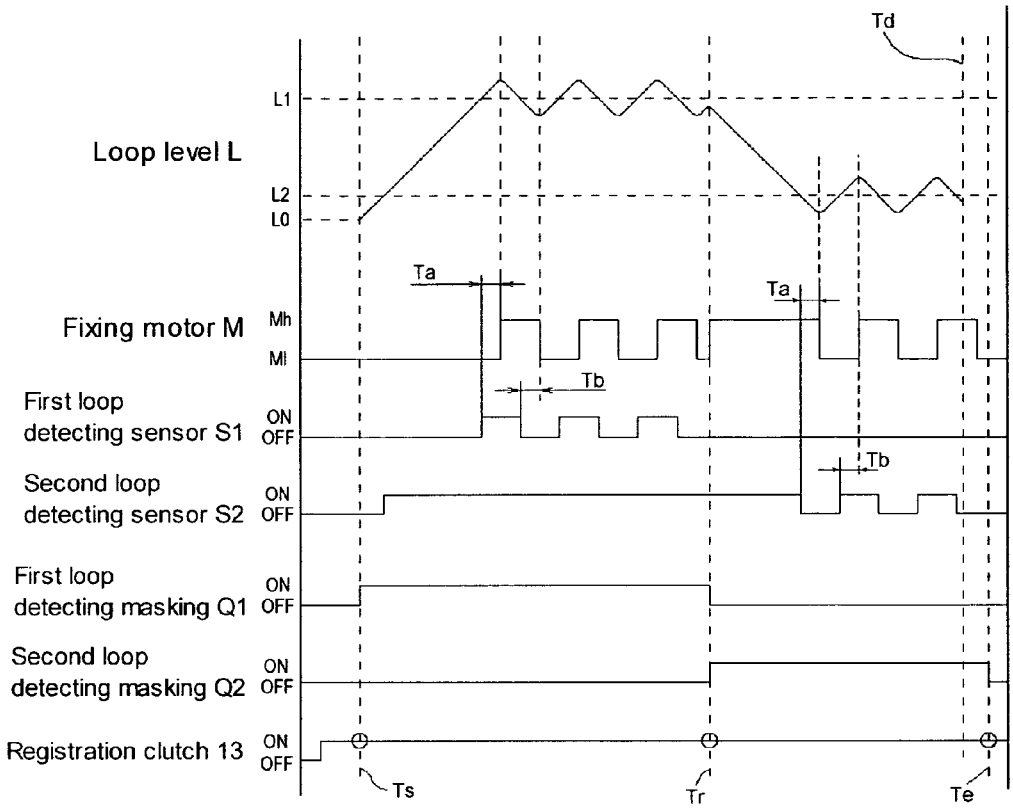
FIG. 2 is a timing chart illustrating control in the image forming apparatus according to the embodiment of the invention.
Figure 3:
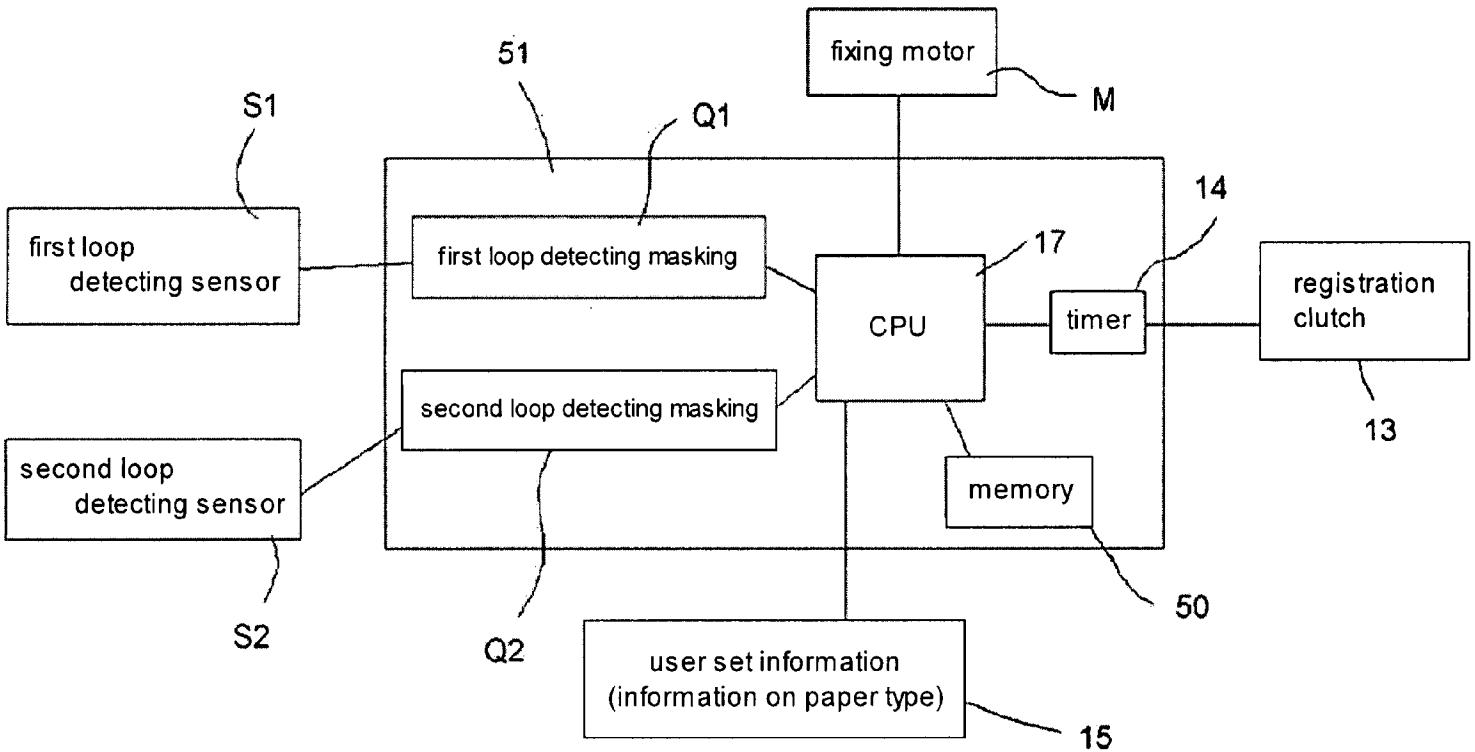
FIG. 3 is a block diagram illustrating a control system of an image forming apparatus according to a first embodiment of the invention.

A description will be given below of an image forming apparatus according to the embodiment of the invention in reference to the drawings. FIG. 1 is a cross-sectional view showing the schematic configuration of essential parts of an image forming apparatus according to the embodiment of the invention; FIG. 2 is a timing chart illustrating the operation of the image forming apparatus according to the embodiment of the invention; FIG. 3 is a block diagram illustrating the image forming apparatus according to the embodiment of the invention; and FIG. 9 is a cross-sectional view showing the general configuration of the image forming apparatus according to the embodiment of the invention.

Explanation will be first made on the schematic configuration of the entire image forming apparatus, and thereafter, on selection of a loop detecting sensor in response to information on a recording material and a loop keeping control for the recording material in response to a detection signal output from a selected loop detecting device.

Figure 9:
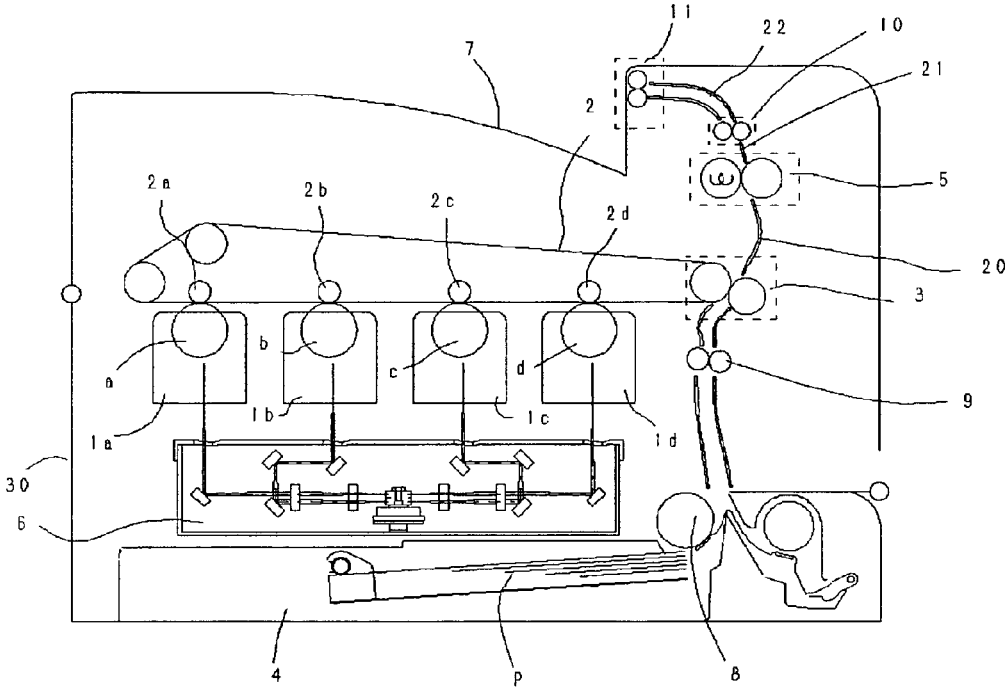
FIG. 9 is a cross-sectional view showing the image forming apparatus according to the embodiment of the invention.

A color image forming apparatus 30 shown in FIG. 9 includes a photosensitive drum a (for a yellow color), a photosensitive drum b (for a magenta color), a photosensitive drum c (for a cyan color) and a photosensitive drum d (for a black color) serving as four image bearing members (i.e., electrophotographic photosensitive members) disposed in parallel to each other, for forming toner images of, for example, yellow, magenta, cyan and black colors; and an intermediate transfer belt 2 serving as an intermediate transfer member disposed over and across the photosensitive drums a to d.

A primary charger, a development device and the like (not shown), are arranged around each of the photosensitive drums a to d driven by motors, not shown. These component parts are unified into each of process cartridges 1*a*, 1*b*, 1*c* and 1*d*, which can be detachably attached to the main body of the image forming apparatus 30.

Furthermore, an exposing device 6 including rotary polygon mirrors and the like is disposed under the photosensitive drums a to d.

A laser beam is projected on the photosensitive drum a in a first image forming device via the rotary polygon mirrors and the like in the exposing device 6 in response to an image signal indicating a yellow component color, and then, an electrostatic latent image is formed on the photosensitive drum a, to be then supplied with a yellow toner from the development device, followed by developing, and thus, the electrostatic latent image is visualized as a yellow toner image.

When the toner image reaches a primary transfer position, at which the photosensitive drum a and the intermediate transfer belt 2 are brought into contact with each other, according to the rotation of the photosensitive drum a, the yellow toner image formed on the photosensitive drum a is transferred onto the intermediate transfer belt 2 by a primary transfer bias applied to a transfer charge member 2*a* (primary transfer). Until the portion of the intermediate transfer belt 2 having the yellow toner image borne thereby is moved to a next image forming device, a magenta toner image is formed on the photosensitive drum b in the same process as that in the preceding image forming device. And then, the magenta toner image is superimposed and transferred onto the yellow toner image formed on the intermediate transfer belt 2 at a primary transfer position, at which the photosensitive drum b and the intermediate transfer belt 2 are brought into contact with each other. In the same manner, as the intermediate transfer belt 2 is further moved, a cyan toner image and a black toner image are sequentially superimposed and transferred on the yellow toner image and the magenta toner image at primary transfer positions in image forming devices, respectively.

In the meantime, recording materials P are placed in a sheet cassette 4. The recording materials P are fed one by one from the sheet cassette 4 by a pickup roller 8, and then, a timing is adjusted by a pair of registration rollers 9, thereafter, the recording material P reaches a secondary transfer position, at which the toner images of the four colors formed on the intermediate transfer belt 2 are transferred onto the recording material P at a time by a secondary transfer bias applied to a secondary transfer roller pair 3 serving as a transfer portion (secondary transfer).

The recording material P having the toner images of the four colors transferred thereonto is transported to a fixing roller pair 5 serving as a fixing device disposed above the transfer roller pair 3 under the guidance of a conveyance guide 20, and thereafter, the toner images of the four colors are fixed to the recording material P with the application of heat and pressure. In this manner, the toners of the colors are fused in mixture, to be thus fixed onto the recording material P as a print image of a full color. Thereafter, the recording material P having the image fixed thereonto is discharged onto a discharge tray 7 by a discharge roller pair 11 serving as discharge means disposed downstream of the fixing roller pair 5 under the guidance of other conveyance guides 21 and 22.

Subsequently, a description will be given of a loop keeping control for the recording material, which is performed between the transfer roller pair 3 and the fixing roller pair 5 in the above-described image forming apparatus. As shown in FIG. 1, the image forming apparatus according to the present embodiment includes: loop detecting sensors S1 and S2 serving as a plurality of loop detecting devices for detecting various levels of loops of the recording materials P between the transfer roller pair 3 and the fixing roller pair 5; and a controlling device 51 for selecting a specific one of the plurality of loop detecting sensors S1 and S2 in accordance with information on the recording material P, so as to switch a recording material conveyance speed of the fixing roller pair 5 in response to a detection signal output from the specific loop detecting sensor, thereby controlling to keep the loop of the recording material P within a predetermined range.

Furthermore, the above-described image forming apparatus includes a fixing motor M serving as a fixing/driving device for rotationally driving the fixing roller pair 5. The fixing motor M can switch the recording material conveyance speed of the fixing roller pair 5 to a plurality of speeds lower or higher than that of the transfer roller pair 3.

As shown in FIG. 3, the above-described controlling device 51 includes a CPU 17, a timer 14, a memory 50, and loop detecting maskings Q1 and Q2 serving as a plurality of masking means capable of making the loop detecting sensors S1 and S2 inoperable, respectively. The controlling device 51 selects the loop detecting sensor for detecting a loop of a level in accordance with information on the recording material out of the plurality of loop detecting sensors S1 and S2, and then, controls the fixing motor M to keep the loop of the recording material P within a predetermined range in response to a detection signal output from the loop detecting sensor selected in accordance with the information on the recording material.

The information on the recording material P includes the size of the recording material (e.g., a length in a conveyance direction) and positions of ends of the recording material (e.g., a leading end and a rear end in the conveyance direction). The information on the recording material P has been stored in advance in the memory 50 in the controlling device 51, and further, has been set before the formation of an image in accordance with information output from a set information input device 15, as shown in FIG. 3. Incidentally, the set information input device 15 may input the information from an operation panel in the image forming apparatus, may automatically input information detected by size detecting means (not shown) disposed in the sheet cassette 4, or may automatically input information on the recording material during conveyance, detected by detecting means such as a CCD. The various pieces of input information are sent to the controlling device 51.

The controlling device 51 selects the loop detecting sensor for detecting a level of a loop in accordance with the size of the recording material P and the position of the end of the recording material P out of the plurality of loop detecting sensors S1 and S2.

Specifically, the controlling device 51 selectively uses the plurality of loop detecting sensors S1 and S2 and controls fixing motor M in response to detecting result of the selected loop detecting sensor. The controlling device 51 has a first mode that keeps the loop of the recording material within a first range in response to a detection signal output from the loop detecting sensor S1. And the controlling device 51 has a second mode that keeps the loop of the recording material within a second range in response to a detection signal output from the loop detecting sensor S2. The loop detecting sensor S2 is adapted to detect a level of a loop smaller than that detected by the loop detecting sensor S1. The controlling device 51 selects the first loop detecting sensor S1 for use in the loop detection during a predetermined period of time in accordance with the size of the recording material after the leading end of the recording material P reaches the fixing roller pair 5 till the rear end of the recording material P reaches the transfer roller pair 3. Moreover, the controlling device 51 selects the second loop detecting sensor S2, which detects the level of the loop smaller than that detected by the loop detecting sensor S1, for use in the loop detection after a lapse of the predetermined period of time until the rear end of the recording material P reaches the transfer roller pair 3.

Hereinafter, explanation will be made in detail on the selection of the loop detecting sensor in accordance with the information on the recording material and the loop keeping control for the recording material in response to a detection signal output from a selected loop detecting device.

The recording materials P are fed one by one from the sheet cassette 4 by the pickup roller 8, and then, the timing is adjusted by the registration rollers 9 which stay still.

As shown in FIGS. 2 and 3, when a registration clutch 13 of a drive system of the registration rollers 9 is turned on, the drive is transmitted to the registration rollers 9, so that the recording material P is transported to the secondary transfer roller pair 3 at the secondary transfer position. Moreover, upon the turning-on of the registration clutch 13, the timer 14 in the controlling device 51 starts counting.

Figure 4:
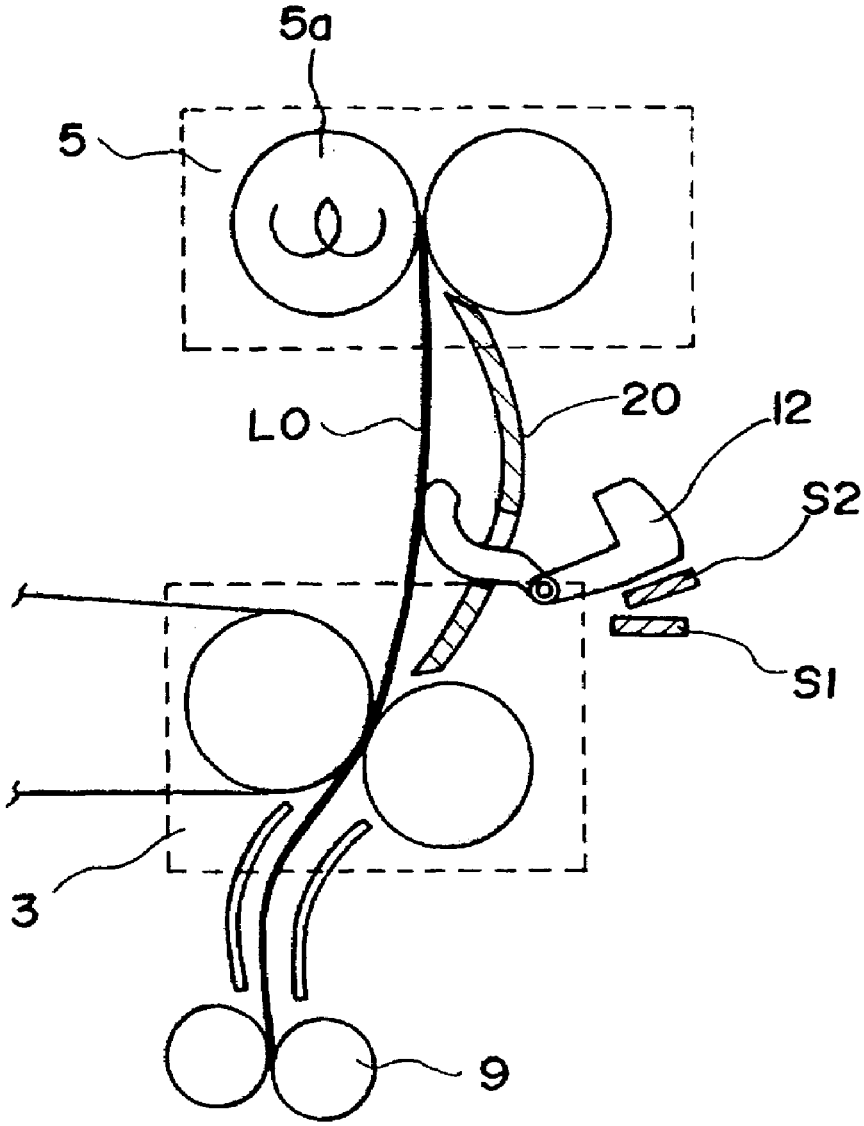
FIG. 4 is a partly cross-sectional view showing a looped state of a recording material which passes through a transfer portion and a fixing device in the image forming apparatus according to the embodiment of the invention.

When the recording material P reaches the secondary transfer position, the toner images of the four colors formed on the intermediate transfer belt 2 are transferred onto the recording material P at a time by the secondary transfer bias applied to the secondary transfer roller pair 3 (secondary transfer). The recording material P having the toner images of the four colors transferred thereonto is guided by the conveyance guide 20, and then, enters into a nip portion in the fixing roller pair 5 while a loop L0 is formed, as shown in FIG. 4.

Incidentally, the fixing roller pair 5 is driven by the fixing motor (i.e., the fixing/driving device) M serving as a drive source independent of drive sources for the photosensitive drums, the development device, the intermediate transfer belt and the discharge roller pair, as described above. In addition, the fixing motor M is a stepping motor, which is configured such that a rotational speed can be switched in response to a pulse signal output from a driver in the controlling device 51.

As illustrated in FIG. 2, a timing when the leading end of the recording material P enters into the fixing roller pair 5, that is, a lapse of time Ts after the start of the timer 14 has been set previously in the memory 50 as a starting timing of the first loop detecting masking Q1. In other words, the loop detecting masking Q1 is turned on, and then, a signal output from the loop detecting sensor S1 is started to be read by the CPU 17. In this manner, the first loop detecting sensor S1 for detecting a loop L1 on a level (i.e., a first loop) in accordance with the information on the recording material P is selected out of the two loop detecting sensors S1 and S2 in response to the information on the recording material P previously stored in the memory 50.

Figure 5:
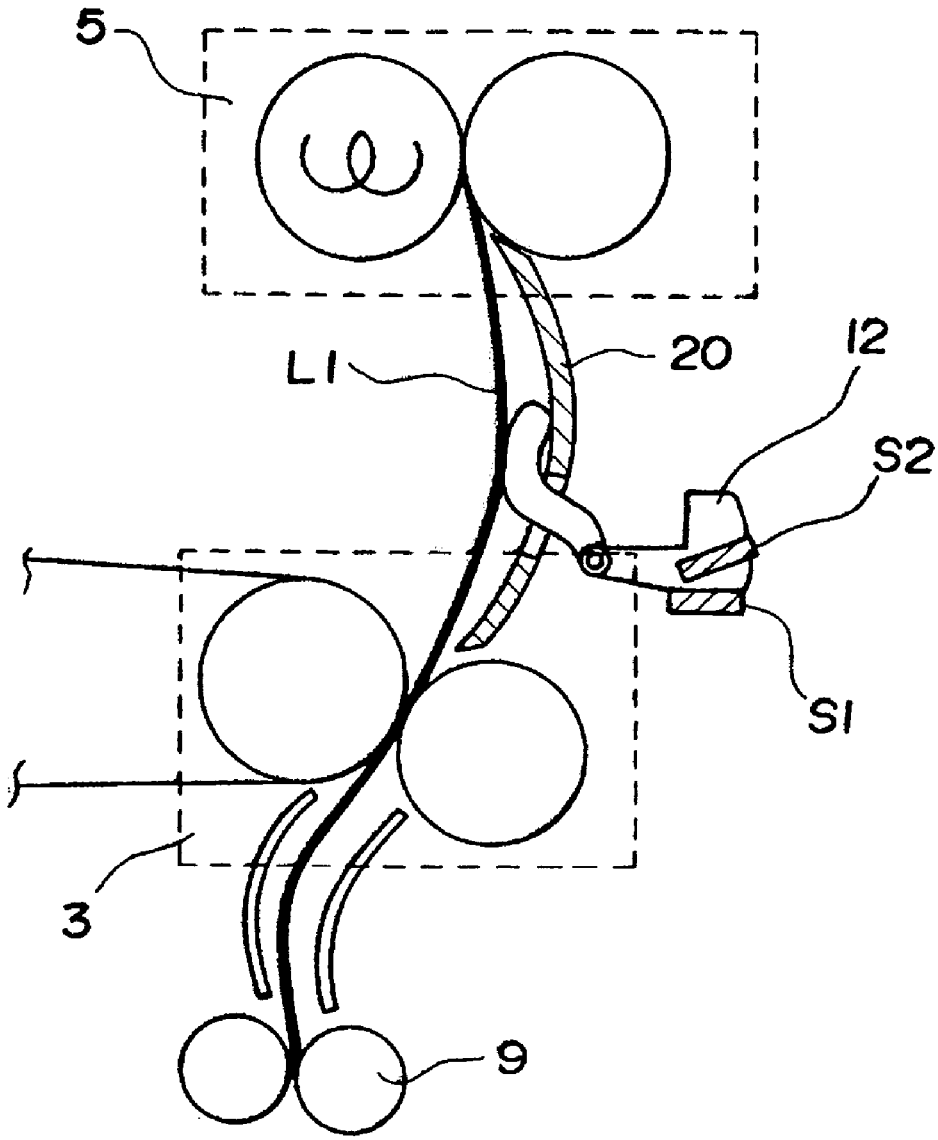
FIG. 5 is a cross-sectional view showing one example of a looped shape between the transfer portion and the fixing device according to the invention.
Figure 6:
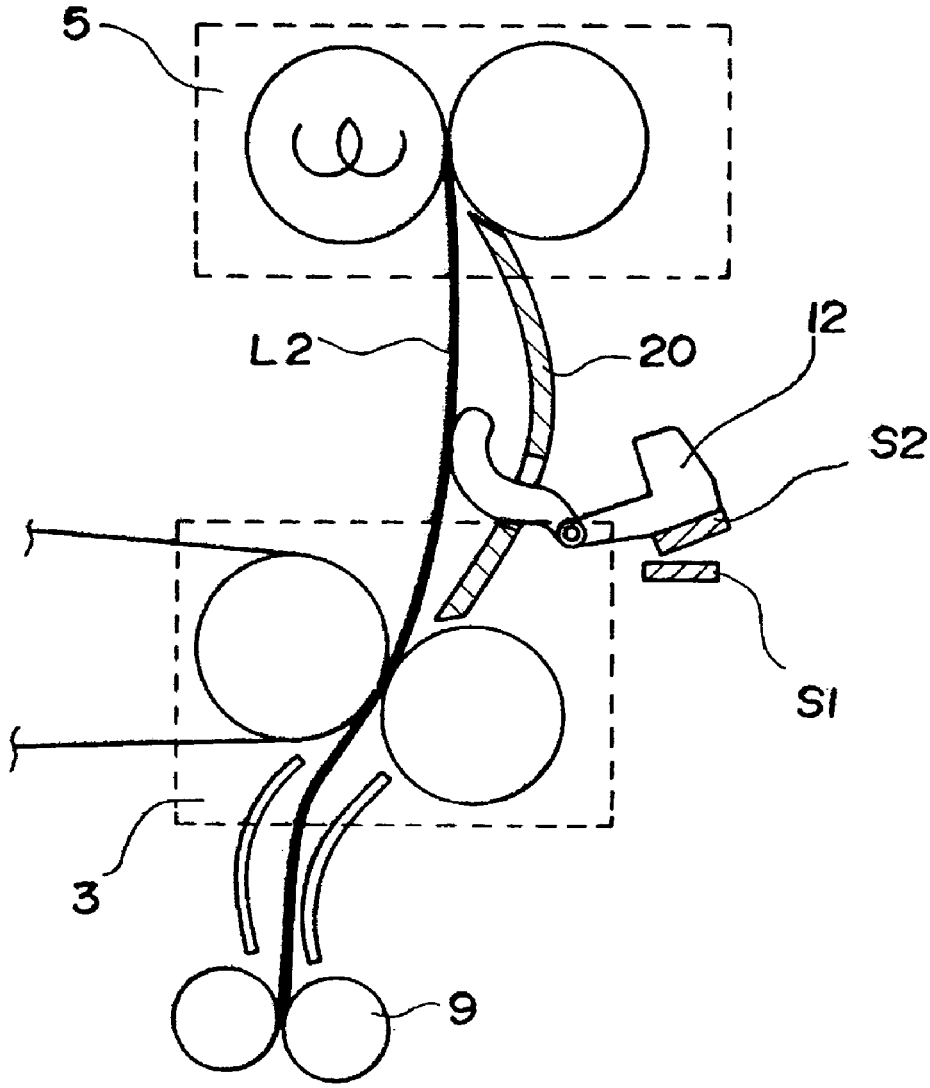
FIG. 6 is a cross-sectional view showing another example of the looped shape between the transfer portion and the fixing device according to the invention.

Here, as shown in FIGS. 5 and 6, the loop detecting sensors S1 and S2 are photo-interrupters, which detect the movement of a loop detecting flag 12 as a single actuator actuated by a contact with the recording material P between the transfer roller pair 3 and the fixing roller pair 5. The first loop detecting sensor S1 and the second loop detecting sensor S2 are arranged in such a manner as to detect the loops at different oscillation angles of the loop detecting flag 12, respectively. That is to say, the first and second loop detecting sensors S1 and S2 are arranged in such a manner as to detect the loops L1 and L2 on different levels of the recording material P between the secondary transfer roller pair 3 and the fixing roller pair 5.

Incidentally, a loop detecting device is not limited to the loop detecting sensors S1 and S2 shown in FIGS. 5 and 6, and therefore, it may be a plurality of optical displacement sensors of, for example, a non-contact type for detecting a loop of the recording material P.

When the recording material P enters into the nip portion in the fixing roller pair 5, as described above, a recording material conveyance speed Vf of the fixing roller pair 5 has been previously set to a speed Vf1 lower than a recording material conveyance speed Vt of the secondary transfer roller pair 3 (i.e., a rotational speed Ml of the fixing motor M), so that the loop of the recording material P gradually becomes large between the transfer roller pair 3 and the fixing roller pair 5.

When the gradually enlarged loop of the recording material P reaches a level L2, the loop detecting flag 12 is pressed by the looped recording material P, to be then oscillated, and consequently, the second loop detecting sensor S2 is switched from OFF to ON by the loop detecting flag 12 (see FIG. 6). However, at this timing, since the second loop detecting masking Q2 is OFF (i.e., in an inoperable state), a signal output from the second loop detecting sensor S2 cannot be read by the CPU 17.

As illustrated in FIG. 2, when the loop of the recording material P between the secondary transfer roller pair 3 and the fixing roller pair 5 reaches a level L1, the first loop detecting sensor S1 is switched from OFF to ON by the loop detecting flag 12, which is pressed by the looped recording material P and oscillated (see FIG. 5). At this time, the first loop detecting masking Q1 is ON (i.e., in an operable state), so that the signal output from the first loop detecting sensor S1 is read. As a consequence, when the first loop detecting sensor S1 is turned on, as illustrated in FIG. 2, the fixing motor M is switched such that the recording material conveyance speed Vf of the fixing roller pair 5 becomes a speed Vfh higher than the recording material conveyance speed of the secondary transfer roller pair 3 (i.e., a rotational speed Mh of the fixing motor M) after a lapse of a predetermined delay time Ta. Thus, the loop of the recording material P between the transfer roller pair 3 and the fixing roller pair 5 is gradually reduced on the boundary of the level L1.

When the level of the loop of the recording material P is gradually reduced and the first loop detecting sensor S1 is switched from ON to OFF owing to the oscillation of the loop detecting flag 12 oscillated following the loop of the recording material P, the fixing motor M, as illustrated in FIG. 2, is switched such that the recording material conveyance speed Vf of the fixing roller pair 5 again becomes the speed Vfl lower than the recording material conveyance speed of the secondary transfer roller pair 3 (i.e., the rotational speed Ml of the fixing motor Ml) after a lapse of a predetermined delay time Tb. Thus, the loop of the recording material P between the transfer roller pair 3 and the fixing roller pair 5 is gradually enlarged again on the boundary of the level L1.

By the repetition of the above-described process, the loop of the recording material P can be kept within the first range in reference to the loop level L1. In other words, the looped state of the recording material P between the secondary transfer roller pair 3 and the fixing roller pair 5 can be substantially kept on the loop level L1 in the first mode, as illustrated in FIG. 2.

Figure 10:
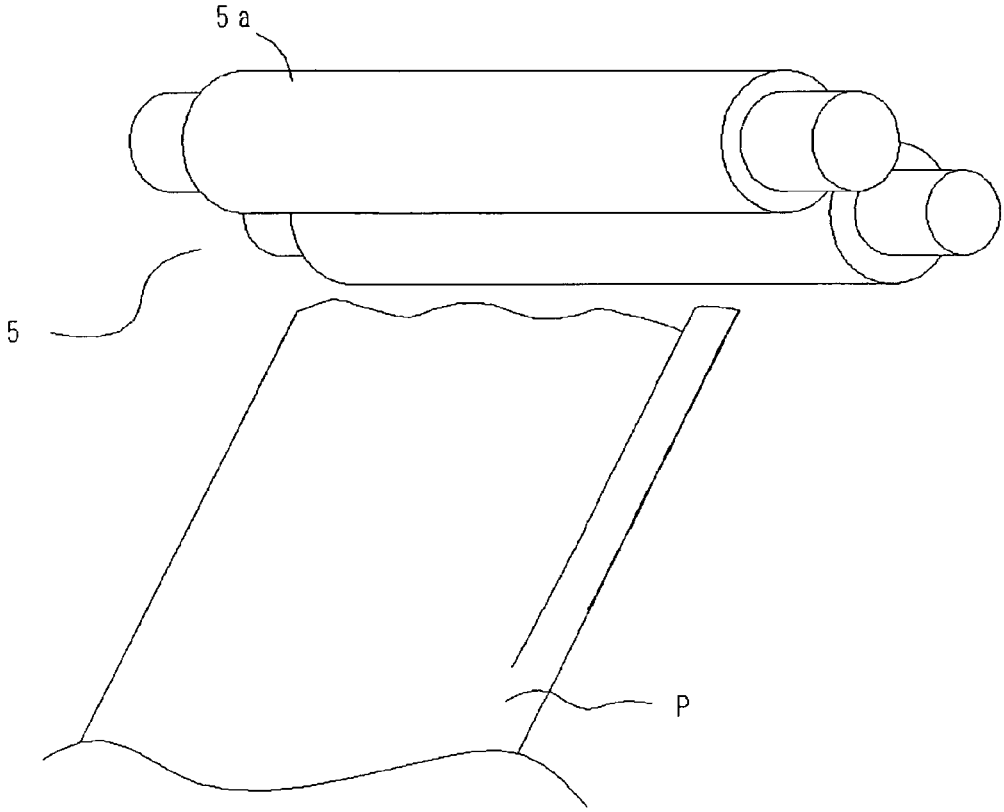
FIG. 10 is a view showing a flexed state of a sheet between the transfer portion and the fixing device.
Figure 11:
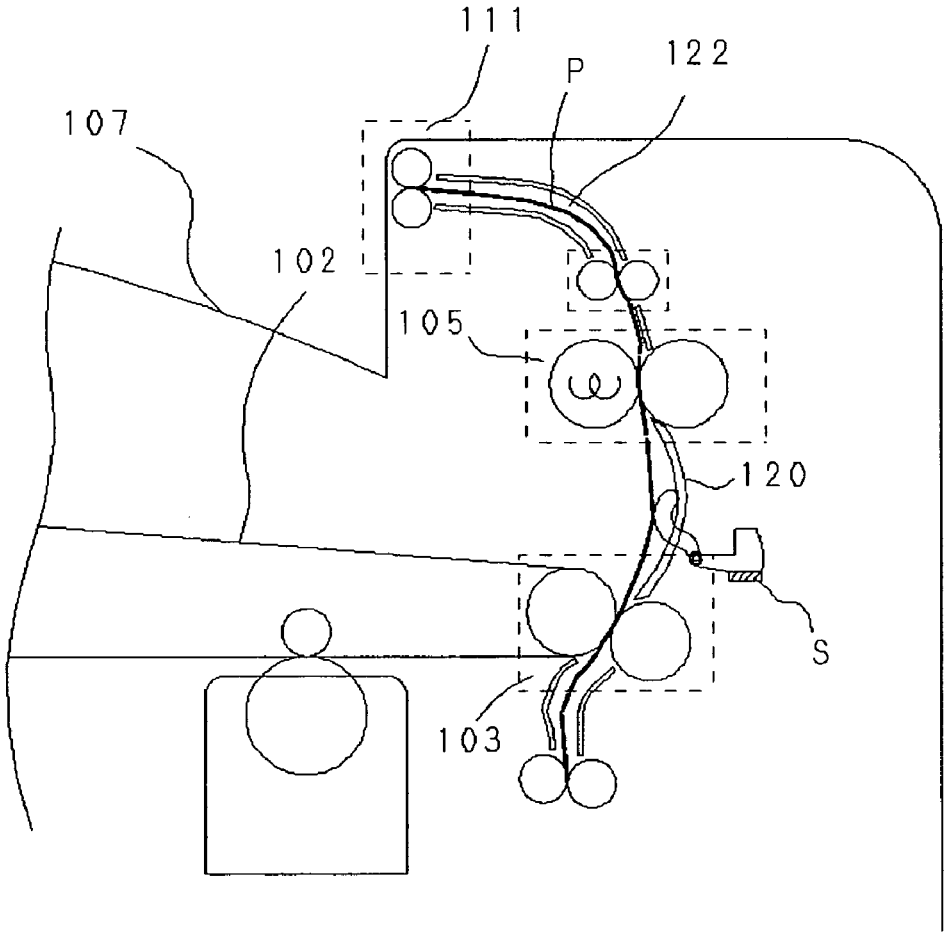
FIG. 11 is a cross-sectional view showing essential parts of an image forming apparatus in the conventional technique in a looped state between a transfer portion and a fixing device.

Here, a detection position by the first loop detecting sensor S1 is determined to be controlled on a level of a loop, which does not induce any blur of an image when the recording material P is transported in a corrugated state on the assumption that the recording material P is corrugated in a width direction perpendicular to the conveyance direction. Specifically, when an image is formed on the recording material P such as a thin plain paper or a plain paper in a highly humid environment, the recording material P may be corrugated in the width direction crossing the conveyance direction, as shown in FIG. 10. In this case, there is a fear that a blur occurs on an image to be formed on the recording material P having a unfixed image thereon if the crest of the recording material P having a unfixed toner image transferred thereonto is brought into contact with the fixing roller facing to a side of the recording material P having the unfixed image (i.e., a left fixing roller 5*a* of the fixing roller pair 5 in FIG. 4) before the recording material P enters into the nip portion at the fixing roller pair 5. In view of this, the first loop detecting sensor S1 controls to hold the recording material P in the large loop level L1, thereby separating the side of the recording material P having the unfixed image from the fixing roller 5*a*, so as to prevent the crest of the recording material from being brought into contact with the fixing roller 5*a*.

Additionally, in order to eliminate the above-described corrugation of the recording material P in the width direction, the fixing roller pair 5 is formed into a crown shape. Thus, the corrugation of a portion of the recording material P nipped in the fixing roller pair 5 can be eliminated as the recording material is being transported. The crown shape signifies a shape whose outer diameter is increased from a center to both ends in a roller longitudinal direction (i.e., an axial direction). Since the fixing roller pair 5 is formed into the crown shape, the conveyance speed of the recording material P at the nip portion is high at both ends but low at the center. As a consequence, it is possible to produce an effect of tension of the recording material P toward both ends, thereby eliminating the corrugation as the recording material P is being transported.

Here, if the recording material P is kept to be transported in the looped state (on the loop level L1) in response to the detection signal output from the first loop detecting sensor S1, the rear end of the recording material P bounces up when the rear end of the recording material P passes through the secondary transfer roller pair 3, thereby leading to the deficiency of the image.

In view of this, a time, during which the corrugation is eliminated by the effect of the crown shape of the fixing roller pair 5, is a time Tr set by the timer 14. As illustrated in FIG. 2, the first loop detecting masking Q1 is turned off at the time Tr, so that reading the signal output from the first loop detecting sensor S1 by the CPU 17 is finished. Incidentally, the time, during which the corrugation is eliminated in accordance with the size of the recording material P, has been previously verified by an experiment or the like, and thus, the time Tr has been set in response to the verified time.

At the same time, the second loop detecting masking Q2 is turned on, and then, reading the signal output from the second loop detecting sensor S2 by the CPU 17 is started. Furthermore simultaneously, the rotational speed of the fixing motor M is switched to the rotational speed Mh on a high speed side (i.e., the speed Vfh, at which the recording material conveyance speed Vf of the fixing roller pair 5 is higher than the recording material conveyance speed of the secondary transfer roller pair 3), so that the loop of the recording material P gradually becomes small between the transfer roller pair 3 and the fixing roller pair 5. This is because the loop keeping control is performed in response to the detection signal output from the second loop detecting sensor S2 for detecting the loop smaller than that detected by the first loop detecting sensor S1.

When the gradually reduced loop of the recording material P reaches the loop level L2 of the recording material P between the secondary transfer roller pair 3 and the fixing roller pair 5, the second loop detecting sensor S2 is switched from ON to OFF owing to the oscillation of the loop detecting flag 12 oscillated following the loop of the recording material P (see FIG. 6).

Thereafter, the loop keeping control in response to the detection signal output from the second loop detecting sensor S2 is performed in the same manner as the above-described loop keeping control in response to the detection signal output from the first loop detecting sensor S1. Specifically, when the second loop detecting sensor S2 is turned off, the fixing motor M is switched such that the recording material conveyance speed Vf of the fixing roller pair 5 becomes the speed Vfl lower than the recording material conveyance speed of the secondary transfer roller pair 3 (i.e., the rotational speed Ml of the fixing motor M) after the lapse of the predetermined delay time Ta, as illustrated in FIG. 2. Thus, the loop of the recording material P between the transfer roller pair 3 and the fixing roller pair 5 is gradually enlarged on the boundary of the loop level L2.

The level of the loop of the recording material P is gradually enlarged, and further, the second loop detecting sensor S2 is switched from OFF to ON owing to the oscillation of the loop detecting flag 12 oscillated following the loop of the recording material P. As illustrated in FIG. 2, the fixing motor M is switched such that the recording material conveyance speed Vf of the fixing roller pair 5 again becomes the speed Vfh higher than the recording material conveyance speed of the secondary transfer roller pair 3 (i.e., the rotational speed Mh of the fixing motor Ml) after the lapse of the predetermined delay time Tb. Thus, the loop of the recording material P between the transfer roller pair 3 and the fixing roller pair 5 is gradually reduced again on the boundary of the loop level L2.

By the repetition of the above-described process, the loop of the recording material P can be kept within the second range in reference to the loop level L2. In other words, the looped state of the recording material P between the secondary transfer roller pair 3 and the fixing roller pair 5 can be substantially kept on the loop level L2 in the second mode lower than the loop level L1 in the first mode.

Since the loop level L2, which is controlled in response to the detection signal output from the second loop detecting sensor S2, is low, the rear end of the recording material P can be suppressed from bouncing up at a time Td when the recording material P passes through the secondary transfer roller pair 3 (see FIG. 2).

The loop of the recording material P is released after the rear end of the recording material P passes through the secondary transfer roller pair 3, so that the second loop detecting sensor S2 cannot detect the loop of the recording material P.

As a consequence, the timing when the rear end of the recording material P passes through the secondary transfer roller pair 3 is set to a time Te, which is counted by the timer 14, in response to the information on the recording material P stored previously in the memory 50 (e.g., the length in the conveyance direction), as described above. As illustrated in FIG. 2, when a value counted by the timer 14 reaches the time Te, the second loop detecting masking Q2 is turned off, and thus, reading the signal output from the second loop detecting sensor S2 by the CPU 17 is finished. That is to say, the second loop detecting sensor S2 becomes inoperable.

At the same time, the rotational speed of the fixing motor M is switched to the rotational speed Ml on a low speed side (i.e., the speed Vfl, at which the recording material conveyance speed Vf of the fixing roller pair 5 is lower than the recording material conveyance speed of the secondary transfer roller pair 3) preparatory to the entry of a subsequent recording material P into the fixing roller pair 5.

Incidentally, a timing when the second loop detecting sensor S2 becomes inoperable by the second loop detecting masking Q2 may be set within a range after the rear end of the preceding recording material P has passed through the secondary transfer roller pair 3 until the subsequent recording material P is nipped by and transported to the fixing roller pair 5.

Thereafter, the rear end of the recording material P passes through the fixing roller pair 5 and a first discharge roller pair 10 in sequence, and finally, the recording material P is discharged onto the discharge tray 7 by the second discharge roller pair 11.

As described above, the looped state of the recording material P between the transfer roller pair 3 and the fixing roller pair 5 can be appropriately selected and kept on the loop level in accordance with the information on the recording material P in the present embodiment, thus suppressing various kinds of degradation of the image quality caused by the transported state of the recording material P between the transfer roller pair 3 and the fixing roller pair 5 after the leading end of the recording material P is nipped by the fixing roller pair 5 until the rear end of the recording material P passes through the transfer roller pair 3.

Specifically, it is possible to not only accurately control the transported state of the recording material when the loop is formed on the recording material between the transfer roller pair 3 and the fixing roller pair 5 but also suppress the recording material P from bouncing up due to its own tenacity upon the release of the forcible loop formation when the rear end of the recording material P passes through the transfer roller pair 3, so as to restrain any degradation of the image quality caused by the bounce of the recording material. In particular, since the rear end is designed to pass through the transfer roller pair 3 in the state in which a small loop is formed on the recording material P, the bounce can be suppressed at which the rear end of the recording material passes or the deficient transfer of the image cannot occur even with a failure of the timing, unlike the conventional technique.

Additionally, the actuator detected by the plurality of loop detecting devices in association with the contact with the recording material (i.e., the loop detecting flag 12) is constituted of a single member, thus achieving a simple configuration and reducing a cost.

Second Embodiment

Figure 7:
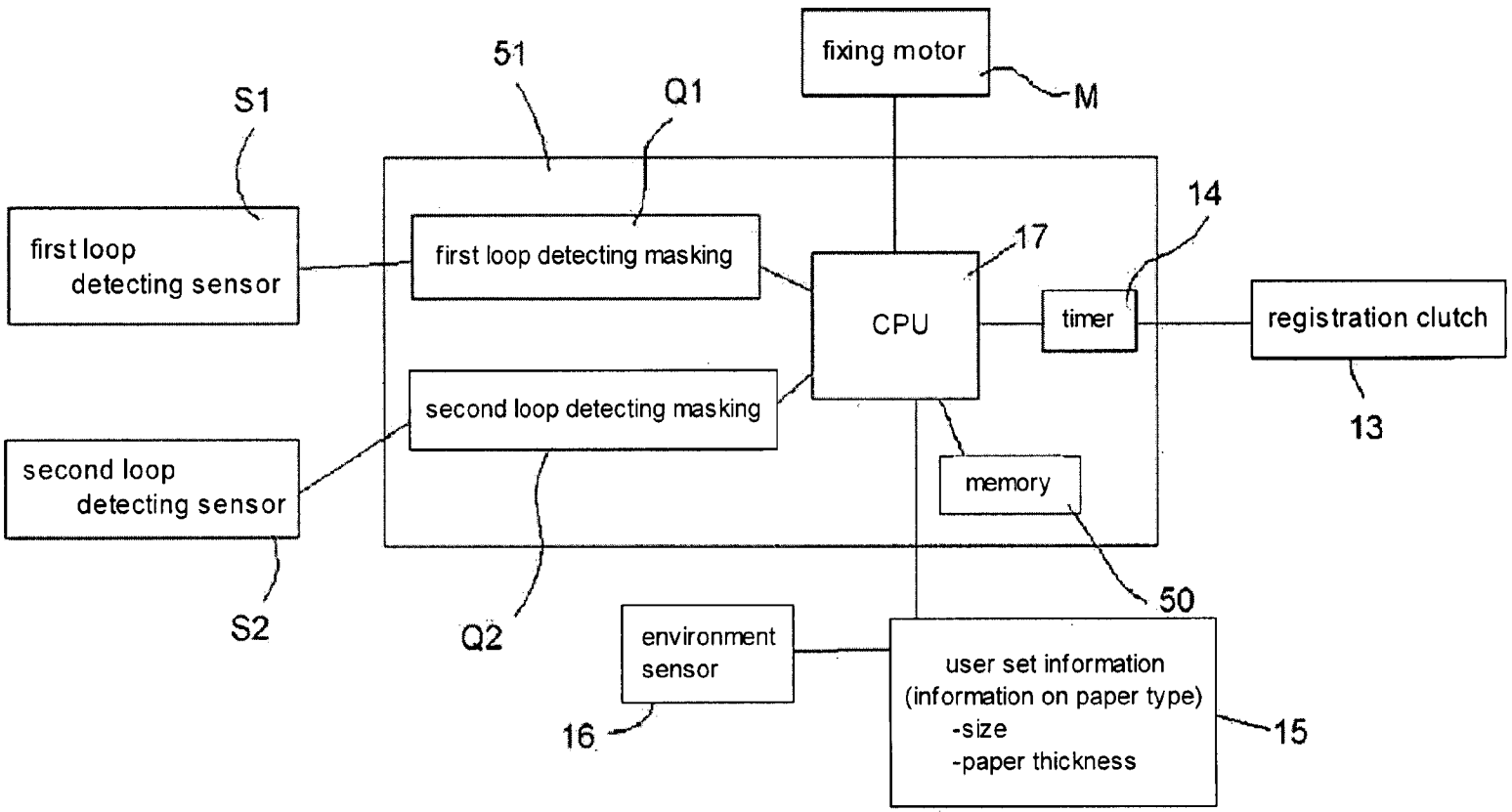
FIG. 7 is a block diagram illustrating a control system of an image forming apparatus according to the embodiment of the invention.

A description will be given below of an image forming apparatus according to a second embodiment of the invention in reference to the drawings. FIG. 7 is a block diagram illustrating a control system of the image forming apparatus according to the second embodiment of the invention, and FIG. 8 is a table illustrating constant tables stored in a memory in the image forming apparatus according to the second embodiment of the invention.

The present embodiment is the same in configuration as the above-described first embodiment, but is different in that information on a recording material includes information on a rigidity of a recording material and environmental information. Moreover, a controlling device is designed in such a manner as to select a loop detecting device for detecting a loop in accordance with the information on the rigidity of the recording material and the environmental information out of a plurality of loop detecting devices. Incidentally, the configuration and a loop keeping control in the present embodiment are identical to those in the first embodiment, and therefore, they are referred to FIGS. 1, 2 and 4 to 6.

A set information input device 15 illustrated in FIG. 7 inputs paper type information such as a size of a recording material (e.g., a length in a conveyance direction) and positions of ends of the recording material (e.g., a leading end and a rear end in the conveyance direction), paper thickness information indicating a thickness of a recording material, and environmental information on a use environment (such as a temperature or a humidity) of an image forming apparatus and an environment (such as a temperature or a humidity) inside of the image forming apparatus. Here, the paper type information is input by various means, like in the first embodiment. The paper thickness information is input by an operation panel in the image forming apparatus, or information detected by a paper thickness detecting sensor may be automatically input. Furthermore, the environmental information on the use environment such as a temperature or a humidity of the image forming apparatus is detected and automatically input by utilizing an environmental sensor 16. The various pieces of information are sent to a controlling device 51.

In the present embodiment, the controlling device 51 receives the paper thickness information on a recording material P from the set information input device 15. The controlling device 51 predicts the rigidity of the recording material P in response to the paper thickness information, and thus, selects an appropriate loop detecting sensor, which detects a loop level in accordance with the rigidity of the recording material P and has been stored in advance in a memory 100, out of two loop detecting sensors S1 and S2. In addition, the controlling device 51 predicts a corrugation of the recording material P in response to the environmental information on the use environment such as a temperature or a humidity, and thus, selects an appropriate loop detecting sensor, which detects a loop level in accordance with the environmental information and has been stored in advance in the memory 100, out of the two loop detecting sensors S1 and S2.

Here, the loop detecting sensors corresponding to the paper thickness information and the environmental information, which are information relevant to the recording material, are stored in the memory 100 in the form of a constant table per condition, as illustrated in FIG. 8. FIG. 8 exemplifies an A4 size serving as the size of the recording material, a high humidity and a humidity lower than that high humidity serving as the environmental information, and a plain paper serving as the rigidity of the recording material, a paper thinner than the plain paper and a paper thicker than the plain paper. However, the information on the recording material are not limited to the above-described factors.

In the present embodiment, as illustrated in FIG. 8, the controlling device 51 selects the first loop detecting sensor S1 during a predetermined period of time (i.e., from the time Ts to the time Tr illustrated in FIG. 2) in accordance with the size of the recording material (i.e., the A4 size in FIG. 8) after the leading end of the recording material P reaches a fixing roller pair 5 until the rear end of the recording material P reaches a transfer roller pair 3 out of the two loop detecting sensors S1 and S2 in the case where the rigidity of the recording material is a second rigidity (i.e., a thin paper in FIG. 8) smaller than a first rigidity (i.e., a plain paper and a thick paper in FIG. 8) even if a humidity as the environmental information is a first humidity (i.e., a low humidity indicated in FIG. 8) lower than a second humidity (i.e., a high humidity indicated in FIG. 8), and further, selects the second loop detecting sensor S2 for detecting a loop smaller than that detected by the first loop detecting sensor S1 before the rear end of the recording material P reaches the transfer roller pair 3 after a lapse of the predetermined period of time (a constant table d4 illustrated in FIG. 8). That is, the controlling device 51 controls fixing motor M in the first mode and sequentially controls fixing motor M in the second mode.

Incidentally, plain paper in a lowly humid environment is hardly corrugated in the width direction crossing the conveyance direction, so it may be controlled the loop, so in the case where the humidity as the environmental information is the first humidity (i.e., the low humidity indicated in FIG. 8) since the rigidity of the recording material P is not decreased in comparison with the state of the high humidity, the controlling device 51 selects the second loop detecting sensor S2 for detecting the loop smaller than that detected by the first loop detecting sensor S1 out of the plurality of loop detecting sensors S1 and S2 with respect to the recording material having the first rigidity (i.e., the plain paper and the thick paper in FIG. 8) (constant tables d5 and d6 illustrated in FIG. 8). That is, the controlling device 51 controls fixing motor M only in the second mode.

In addition, a thick plain paper is hardly corrugated in the width direction crossing the conveyance direction, so it may be controlled the loop, so the controlling device 51 selects the second loop detecting sensor S2 for detecting the loop smaller than that detected by the first loop detecting sensor S1 out of the plurality of loop detecting sensors S1 and S2 in the case where the rigidity of the recording material is the first rigidity (i.e., the thick paper in FIG. 8) greater than the second rigidity (i.e., the plain paper and the thin paper in FIG. 8) even if the humidity as the environmental information is the second humidity (i.e., the high humidity indicated in FIG. 8) higher than the first humidity (i.e., the low humidity indicated in FIG. 8) (a constant table d3 illustrated in FIG. 8). That is, the controlling device 51 controls fixing motor M only in the second mode.

Incidentally, the controlling device 51 selects the first loop detecting sensor S1 out of the plural loop detecting sensors S1 and S2 with respect to the recording material having the second rigidity (i.e., the plain paper and the thin paper in FIG. 8) during the predetermined period of time (i.e., from the time Ts to the time Tr illustrated in FIG. 2) according to the size of the recording material (i.e., the A4 size in the present embodiment) after the leading end of the recording material reaches the fixing roller pair until the rear end of the recording material reaches the transfer roller pair since the rigidity of the recording material P is decreased in comparison with the rigidity of the recording material P in the low humidity when the humidity as the environmental information is the second humidity (i.e., the high humidity indicated in FIG. 8), and further, selects the second loop detecting sensor S2 for detecting a loop smaller than that detected by the first loop detecting sensor S1 before the rear end of the recording material reaches the transfer roller pair after a lapse of the predetermined period of time (constant tables d1 and d2 illustrated in FIG. 8). That is, the controlling device 51 controls fixing motor M in the first mode and sequentially controls fixing motor M in the second mode.

Here, the loop keeping control after the selection of the loop detecting device is identical to that in the above-described first embodiment.

As described above, like in the above-described embodiment, the looped state of the recording material P between the transfer roller pair 3 and the fixing roller pair 5 can be appropriately selected and kept on the loop level in response to the information on the recording material P in the present embodiment, thus suppressing various kinds of degradation of the image quality caused by the transported state of the recording material P between the transfer roller pair 3 and the fixing roller pair 5 after the leading end of the recording material P is nipped by the fixing roller pair 5 until the rear end of the recording material P passes through the transfer roller pair 3.

In addition, since the loop keeping control is performed in response to the detection signal output from the loop detecting sensor by selecting the loop detecting sensor for detecting an optimum loop according to the paper thickness information on the recording material, the slippage of the recording material P at a nip portion in the transfer roller pair 3 can be reduced by force, by which the recording material having the loop formed thereon is to return to the state before the loop formation, irrespective of the rigidity of the recording material P, thus suppressing a blur of an image or expansion and contraction of the image caused by the slippage of the recording material P.

Moreover, the recording material P tends to be corrugated in a width direction perpendicular to a conveyance direction, and further, such a tendency becomes more conspicuous in an environmental state under higher temperature and higher humidity. However, since the loop keeping control is performed in response to the detection signal output from the loop detecting sensor by selecting the loop detecting sensor for detecting an optimum loop according to the environmental information, an image can be prevented from being blurred even if a crest of the recording material having a unfixed image formed thereon is brought into contact with the fixing roller pair before the leading end of the recording material enters into the nip portion in the fixing roller pair irrespective of the environmental condition.

Other Embodiments

Although in addition to the configuration in the first embodiment, the above-described second embodiment has exemplified the configuration, in which the rigidity of the recording material and the environmental information have been used as the information on the recording material, so as to perform the loop keeping control in response to the pieces of information, the invention is not limited to this. The pieces of information on the recording material may be used independently of each other.

For example, the rigidity of the recording material may be used as the information on the recording material, and further, the controlling device may select the loop detecting device for detecting the loop of a level according to the rigidity of the recording material out of the plurality of loop detecting devices.

Specifically, in the case where the rigidity of the recording material is the second rigidity smaller than the first rigidity, the first loop detecting device may be selected out of the plurality of loop detecting devices during the predetermined period of time according to the size of the recording material after the leading end of the recording material reaches the fixing device until the rear end of the recording material reaches the transfer portion. After the lapse of the predetermined period of time, the second loop detecting device for detecting the loop smaller than that detected by the first loop detecting device may be selected before the rear end of the recording material reaches the transfer portion.

Additionally, in the case where the rigidity of the recording material is the first rigidity greater than the second rigidity, the second loop detecting device may be selected out of the plurality of loop detecting devices.

Here, the loop keeping control after the selection of the loop detecting device is performed in the same manner as in the above-described first embodiment.

With this configuration, the looped state of the recording material between the transfer portion and the fixing device can be appropriately selected and kept on the loop level in accordance with the rigidity of the recording material, thus suppressing various kinds of degradation of the image quality caused by the transported state of the recording material between the transfer portion and the fixing device after the leading end of the recording material is nipped by the fixing device until the rear end of the recording material passes through the transfer portion in the same manner as in the above-described embodiments.

In addition, since the loop keeping control is performed in response to the detection signal output from the loop detecting device by selecting the loop detecting device for detecting an optimum loop according to the rigidity of the recording material, the slippage of the recording material at the nip portion in the transfer portion can be reduced by force, by which the recording material having the loop formed thereon try to return to the state before the loop formation, irrespective of the rigidity of the recording material, thus suppressing the blur of the image or the expansion and contraction of the image caused by the slippage of the recording material.

Alternatively, the environmental information may be used as the information on the recording material, and further, the controlling device may select the loop detecting device for detecting the loop of a level according to the environmental information out of the plurality of loop detecting sensors.

Specifically, in the case where the humidity as the environmental information is the second humidity higher than the first humidity, the first loop detecting device may be selected out of the plurality of loop detecting devices during the predetermined period of time according to the size of the recording material after the leading end of the recording material reaches the fixing device until the rear end of the recording material reaches the transfer portion. After the lapse of the predetermined period of time, the second loop detecting device for detecting the loop smaller than that detected by the first loop detecting device may be selected before the rear end of the recording material reaches the transfer portion.

Additionally, in the case where the humidity as the environmental information is the first humidity lower than the second humidity, the second loop detecting device may be selected out of the plurality of loop detecting devices.

Here, the loop keeping control after the selection of the loop detecting device is performed in the same manner as in the above-described first embodiment.

With this configuration, the looped state of the recording material between the transfer portion and the fixing device can be appropriately selected and kept on the loop level in accordance with the environmental information such as the temperature or humidity in the use environment, thus suppressing various kinds of degradation of the image quality caused by the transported state of the recording material between the transfer portion and the fixing device after the leading end of the recording material is nipped by the fixing device until the rear end of the recording material passes through the transfer portion in the same manner as in the above-described embodiments.

In addition, since the loop keeping control is performed in response to the detection signal output from the loop detecting device by selecting the loop detecting device for detecting an optimum loop according to the information on the thickness of the recording material, the slippage of the recording material at the nip portion in the transfer portion can be reduced by force, by which the recording material having the loop formed thereon try to return to the state before the loop formation, irrespective of the rigidity of the recording material, thus suppressing the blur of the image or the expansion and contraction of the image caused by the slippage of the recording material.

Although the plurality of loop detecting devices for detecting the various loops formed on the recording materials have been exemplified by the two loop detecting sensors in the above-described embodiments, it may be formed the various loops on the recording materials in response to the detection result by only one loop detecting device. In particular, a level of the loop between the transfer roller pair 3 and the fixing roller pair 5 is changed by the change of a length of the predetermined delay time Ta or delay time Tb when one loop detecting device is switched from OFF to ON or from ON to OFF. For example, when the fixing motor M is switched such that the recording material conveyance speed Vf of the fixing roller pair 5 becomes the speed Vfh, if the delay time Tb is constant, the level of the loop is large in case of setting the delay time Ta long and the level of the loop is small in case of setting the delay time Ta short. So in a first mode the delay time Ta is set long so as to keep the large loop of the recording material within the first range and in a second mode the delay time Ta is set short so as to keep the small loop within the second range. That is, the controlling device 51 controls fixing motor M in the first mode and sequentially controls fixing motor M in the second mode.

In addition, although the image forming apparatus using the four image forming devices for the purpose of the color image formation has been illustrated in the above-described embodiments, the number of image forming devices to be used is not limited to four, and therefore, it may be appropriately set, as required.

Moreover, although the image forming apparatus has been exemplified by the printer in the above-described embodiments, the invention is not limited to the printer. For example, the image forming apparatus may be exemplified by other image forming apparatuses such as a copying machine and a facsimile, other image forming apparatuses such as a composite machine having the functions of a copying machine and a facsimile in combination, an image forming apparatus, which uses a recording material bearing member and in which color toner images are transferred in sequential superimposition onto a recording material borne by the recording material bearing member, or an image forming apparatus, which uses a drum-like image bearing member as the intermediate transfer member in place of the above-described belt-like image bearing member and in which color toner images are transferred in sequential superimposition onto the intermediate transfer member, and then, the toner images borne by the intermediate transfer member are transferred onto a recording material at a time. The same effects as those produced in the above-described embodiments can be produced by applying the invention to the image forming apparatus.

This application claims the benefit of priority from the prior Japanese Patent Application No. 2005-094639 filed on Mar. 29, 2005 the entire contents of which are incorporated by reference herein.

What is claimed is:

1. An image forming apparatus comprising:

a transfer portion which transfers a unfixed image borne by an image bearing member onto a recording material;

a fixing device which fixes the unfixed image transfeffed at the transfer portion onto a recording material;

a controlling device which controls a recording material conveyance speed of the fixing device so as to form a loop of the recording material between the transfer portion and the fixing device in a first mode which keep the loop of the recording material within a first range and in a second mode which keep the loop within a second range, a level of the loop within the second range is smaller than a level of the loop within the first range;

wherein after a leading end of the recording material reaches the fixing device, the controlling device controls the recording material conveyance speed of the fixing device in the first mode, and before a rear end of the recording material reaches the transfer portion, the controlling device switches the recording material conveyance speed of the fixing device from the first mode to the second mode wherein the controlling device controls the recording material conveyance speed of the fixing device in the first mode and the second mode sequentially in the case where a rigidity of the recording material is smaller than a predetermined rigidity, and the controlling device controls the recording material conveyance speed of the fixing device in the second mode in the case where the rigidity of the recording material is greater than the predetermined rigidity.

2. An image forming apparatus comprising:

a transfer portion which transfers an unfixed image borne by an image bearing member onto a recording material;

a fixing device which fixes the unfixed image transferred at the transfer portion onto a recording material;

a controlling device which controls a recording material conveyance speed of the fixing device so as to form a loop of the recording material between the transfer portion and the fixing device in a first mode which keep the loop of the recording material within a first range and in a second mode which keep the loop within a second range, a level of the loop within the second range is smaller than a level of the loop within the first range;

wherein after a leading end of the recording material reaches the fixing device, the controlling device controls the recording material conveyance speed of the fixing device in the first mode, and before a rear end of the recording material reaches the transfer portion, the controlling device switches the recording material conveyance speed of the fixing device from the first mode to the second mode, wherein the controlling device controls the recording material conveyance speed of the fixing device in the first mode and the second mode sequentially in the case where a humidity in a use environment is higher than a predetermined value, the controlling device controls the recording material conveyance speed of the fixing device in the second mode in the case where the humidity of the environment is lower than the predetermined value.

3. The image forming apparatus according to claim 2, wherein the controlling device controls the recording material conveyance speed of the fixing device in the second mode in the case where the rigidity of the recording material is greater than the predetermined rigidity even if the humidity in the use environment is higher than the predetermined value.

4. The image forming apparatus according to claim 3, wherein the controlling device controls the recording material conveyance speed of the fixing device in the first mode and second mode sequentially in the case where the rigidity of the recording material is smaller than the predetermined rigidity even if the humidity in the use environment is lower than the predetermined value.

5. An image forming apparatus comprising:

a transfer portion which transfers a unfixed image borne by an image bearing member onto a recording material;

a fixing device which is able to switch a conveyance speed of the recording material and fixes the unfixed image transferred at the transfer portion;

first and second loop detecting devices which detect respectively different levels of loops formed on the recording material between the transfer portion and the fixing device, the level of the loop detected by the second loop detecting device is smaller than a level of the loop detected by the first loop detecting device; and a controlling device which controls a recording material conveyance speed of the fixing device in response to a detection result from the loop detecting device, so as to keep the loop of the recording material within a constant range;

wherein after a leading end of the recording material reaches the fixing device, the controlling device controls the recording material conveyance speed of the fixing device in response to a detection result of the first loop detecting device, and before a rear end of the recording material reaches the transfer portion, the controlling device controls the recording material conveyance speed of the fixing device in response to a detection result of the second loop detecting device wherein the controlling device controls in response to a detection result by the first loop detecting device to a control in response to the detection result by the second loop detecting device in accordance with size information on the recording material.

6. The image forming apparatus according to claim 5, further comprising:

a fixing-driving device which rotationally drives the fixing device and can switch the recording material conveyance speed of the fixing device to a speed lower or higher than that of the transfer portion;

wherein the controlling device includes a plurality of mask means capable of making each of the loop detecting devices inoperable, and controls the drive of the fixing-driving device in such a manner as to keep the loop of the recording material within the predetermined range in response to the detection signal output from the loop detecting device which is operated by the mask means.

7. An image forming apparatus comprising:

a transfer portion which transfers an unfixed image borne by an image bearing member onto a recording material;

a fixing device which is able to switch a conveyance speed of the recording material and fixes the unfixed image transfeffed at the transfer portion;

first and second loop detecting devices which detect respectively different levels of loops formed on the recording material between the transfer portion and the fixing device, the level of the loop detected by the second loop detecting device is smaller than a level of the loop detected by the first loop detecting device; and a controlling device which controls a recording material conveyance speed of the fixing device in response to a detection result from the loop detecting device, so as to keep the loop of the recording material within a constant range;

wherein after a leading end of the recording material reaches the fixing device, the controlling device controls the recording material conveyance speed of the fixing device in response to a detection result of the first loop detecting device, and before a rear end of the recording material reaches the transfer portion, the controlling device controls the recording material conveyance speed of the fixing device in response to a detection result of the second loop detecting device.

wherein the controlling device controls the recording material conveyance speed of the fixing device in response to the detection result by the first loop detecting device and the second loop detecting device sequentially in the case where a rigidity of the recording material is smaller than a predetermined rigidity, and the controlling device only controls in response to the detection result by the second loop detecting device in the case where the rigidity of the recording material is greater than the predetermined rigidity.

8. An image forming apparatus comprising:

a transfer portion which transfers an unfixed image borne by an image bearing member onto a recording material;

a fixing device which is able to switch a conveyance speed of the recording material and fixes the unfixed image transfeffed at the transfer portion;

first and second loop detecting devices which detect respectively different levels of loops formed on the recording material between the transfer portion and the fixing device, the level of the loop detected by the second loop detecting device is smaller than a level of the loop detected by the first loop detecting device; and a controlling device which controls a recording material conveyance speed of the fixing device in response to a detection result from the loop detecting device, so as to keep the loop of the recording material within a constant range;

wherein after a leading end of the recording material reaches the fixing device, the controlling device controls the recording material conveyance speed of the fixing device in response to a detection result of the first loop detecting device, and before a rear end of the recording material reaches the transfer portion, the controlling device controls the recording material conveyance speed of the fixing device in response to a detection result of the second loop detecting device, wherein the controlling device controls in response to the detection result by the first loop detecting device and in response to the detection result by the second loop detecting device sequentially in the case where a humidity in a use environment is higher than a predetermined value, the controlling device only controls in response to the detection result by the second loop detecting device in the case where the humidity as environmental information is lower than the predetermined value.

9. The image forming apparatus according to claim 8, wherein the controlling device controls in response to the detection result by the second loop detecting device from a reach of the leading end of the recording material to the fixing device to a reach of the rear end of the recording material to the transfer portion in the case where the rigidity of the recording material is greater than the predetermined rigidity even if the humidity in the use environment is higher than the predetermined value.

10. The image forming apparatus according to claim 8, wherein the controlling device controls the recording material conveyance speed of the fixing device in response to the result of the first loop detecting device and the result of the second loop detecting device sequentially in the case where the rigidity of the recording material is smaller than the predetermined rigidity even if the humidity in the use environment is lower than the predetermined value.

* * * * *

UNITED STATES PATENT AND TRADEMARK OFFICE

CERTIFICATE OF CORRECTION

PATENT NO. : 7,409,172 B2
APPLICATION NO. : 11/374198
DATED : August 5, 2008
INVENTOR(S) : Koshida It is certified that error appears in the above-identified patent and that said Letters Patent is hereby corrected as shown below:

ON THE TITLE PAGE:
At item (56), References Cited, Foreign Patent Documents, "JP 2000056529 2/2000" should read --JP 2000-56529 2/2000--, and "JP 2006053299 2/2006" should read --JP 2006-53299 2/2006--.

COLUMN 1:
Line 7, "a" should read --an--.
Line 13, "a" should read --an--.

COLUMN 3:
Line 4, "An" should read --an--.
Line 6, "transfeffed" should read --transferred--.

COLUMN 8:
Line 44, "a" should read --an--.
Line 45, "a" should read --an--.

COLUMN 12:
Line 44, "be controlled" should read --control--.
Line 59, "be controlled" should read --control--.

COLUMN 16:
Line 29, "a" (second occurrence) should read --an--.
Line 31, "transfeffed" should read --transferred--.

COLUMN 17:
Line 34, "a" (second occurrence) should read --an--.

UNITED STATES PATENT AND TRADEMARK OFFICE

CERTIFICATE OF CORRECTION

PATENT NO. : 7,409,172 B2
APPLICATION NO. : 11/374198
DATED : August 5, 2008
INVENTOR(S) : Koshida It is certified that error appears in the above-identified patent and that said Letters Patent is hereby corrected as shown below:

COLUMN 18:
Line 15, “transfeffed” should read --transferred--.
Line 35, “device.” should read --device,--.
Line 51, “transfeffed” should read --transferred--.

Signed and Sealed this

Thirtieth Day of December, 2008

JON W. DUDAS
*Director of the United States Patent and Trademark Office*